US011162233B2

(12) United States Patent
Wenzelmann

(10) Patent No.: US 11,162,233 B2
(45) Date of Patent: Nov. 2, 2021

(54) ADJUSTABLE WIDTH MOLD

(71) Applicant: Wirtgen GmbH, Windhagen (DE)

(72) Inventor: Harry Wenzelmann, Alpenrod (DE)

(73) Assignee: Wirtgen GmbH

( * ) Notice: Subject to any disclaimer, the term of this patent is extended or adjusted under 35 U.S.C. 154(b) by 86 days.

(21) Appl. No.: 16/809,871

(22) Filed: Mar. 5, 2020

(65) Prior Publication Data

US 2021/0172129 A1 Jun. 10, 2021

Related U.S. Application Data

(60) Provisional application No. 62/944,011, filed on Dec. 5, 2019.

(51) Int. Cl.
*E01C 19/48* (2006.01)
*E01C 19/42* (2006.01)

(52) U.S. Cl.
CPC ..... *E01C 19/48* (2013.01); *E01C 19/42* (2013.01); *E01C 2301/16* (2013.01)

(58) Field of Classification Search
CPC ..... E01C 19/42; E01C 19/48; E01C 2301/16
USPC ..... 404/84.05–85, 101–118
See application file for complete search history.

(56) References Cited

U.S. PATENT DOCUMENTS 1,782,707 A 11/1930 Bayley
3,970,405 A 7/1976 Swisher, Jr. et al.
4,197,032 A 4/1980 Miller
4,379,653 A 4/1983 Brown
4,586,889 A 5/1986 Krohne et al.
4,678,365 A 7/1987 Ban et al.
4,778,305 A 10/1988 Ritchey et al.
4,789,266 A 12/1988 Clarke et al.
4,900,186 A 2/1990 Swisher et al.
4,948,292 A * 8/1990 Haven ..... E01C 19/008 404/118
5,590,977 A 1/1997 Guntert et al.
5,615,972 A 4/1997 Guntert et al.
(Continued)

FOREIGN PATENT DOCUMENTS

DE 19814052 A1 10/1999
EP 1213389 A1 6/2002
(Continued)

OTHER PUBLICATIONS

CMI 2000 Series HVW Hydraulic Variable-Width Slipform Pavers brochure, CMI Corporation, Oklahoma City U.S.A., 6 pages (dated at least as early as Apr. 8, 2001).
(Continued)

*Primary Examiner* — Raymond W Addie
(74) *Attorney, Agent, or Firm* — Lucian Wayne Beavers; Patterson Intellectual Property Law, P.C.

(57) ABSTRACT

An adjustable width mold apparatus for a slipform paver includes a center portion and left and right sideform assemblies. The center portion has left and right lateral ends. Left and right telescoping support assemblies are connected between the sideform assemblies and the center portion. Laterally inner ends of the telescoping support assemblies are connected to the center portion laterally inward of the respective lateral ends of the center portion. One or more spacers may be received between each sideform assembly and the center portion to adjust the width of the mold apparatus.

30 Claims, 18 Drawing Sheets

(56) References Cited

U.S. PATENT DOCUMENTS

| | | | | |
|---|---|---|---|---|
| 5,647,688 | A | 7/1997 | Guntert et al. | |
| 5,941,658 | A | 8/1999 | Lee et al. | |
| 6,022,170 | A | 2/2000 | Rower | |
| 6,390,728 | B1 | 5/2002 | Casters | |
| 6,471,442 | B1 | 10/2002 | Deeb et al. | |
| 6,497,531 | B2 | 12/2002 | Sipherd et al. | |
| 6,582,152 | B2 | 6/2003 | Leone et al. | |
| 6,872,028 | B2 | 3/2005 | Aeschlimann et al. | |
| 6,890,123 | B2 | 5/2005 | Piccoli | |
| 7,651,295 | B2 | 1/2010 | Eppes et al. | |
| 7,950,874 | B2 | 5/2011 | Guntert, Jr. et al. | |
| 8,128,314 | B2 * | 3/2012 | Buschmann | E01C 19/48 404/118 |
| 8,267,619 | B2 | 9/2012 | Munz | |
| 8,864,410 | B1 * | 10/2014 | Kopacz | E01C 19/48 404/118 |
| 8,967,908 | B1 | 3/2015 | Thieme et al. | |
| 9,121,141 | B2 | 9/2015 | Thieme et al. | |
| 9,187,868 | B2 * | 11/2015 | Smieja | E01C 19/42 |
| 10,370,801 | B2 * | 8/2019 | Pinson | E01C 19/48 |
| 2003/0185626 | A1 | 10/2003 | Aeschlimann et al. | |
| 2007/0258769 | A1 * | 11/2007 | Eppes | E01C 19/48 404/118 |

FOREIGN PATENT DOCUMENTS

| | | | |
|---|---|---|---|
| WO | 9528525 | A1 | 10/1995 |
| WO | 9704176 | A1 | 2/1997 |
| WO | 9950503 | A1 | 10/1999 |
| WO | 02101150 | A1 | 12/2002 |
| WO | 2010120722 | A1 | 10/2010 |

OTHER PUBLICATIONS

CMI 2000 Series Paving Kit Arrangements brochure, CMI Corporation, P.O. Box 1985, Oklahoma City, OK 73101 USA, 2 pages (dated at least as early as Apr. 8, 2001).

CMI 2000 Series HVW Models SF-2103, SF-2104 and SF-2204 brochure, CMI Corporation U.S.A., P.O. Box 1985, Oklahoma City, OK 73101, 16 pages (dated at least as early as Apr. 8, 2001).

* cited by examiner

ADJUSTABLE WIDTH MOLD

BACKGROUND OF THE INVENTION

1. Field of the Invention

The present application relates to a slipform paver, and more specifically to an adjustable width mold apparatus for a slipform paver.

2. Description of the Prior Art

A slipform paving machine is designed to move in a paving direction across a ground surface and form concrete into a finished concrete structure. A typical slipform paver machine may be seen in U.S. Pat. No. 6,872,028 (WO 2002/101150) to Aeschlimann et al. Machines like that of Aeschlimann et al. are adjustable in width.

It is also known to provide adjustable width molds for use with adjustable width paving machines. Examples of such adjustable width molds may be seen in Guntert U.S. Pat. No. 7,950,874 and Thieme U.S. Pat. No. 9,121,141.

There is a continuing need for improvements in such adjustable width molds.

SUMMARY OF THE INVENTION

In one embodiment an adjustable width mold apparatus includes a center portion terminating in left and right lateral ends. The mold apparatus further includes a left sideform assembly including a laterally inner end and a right sideform assembly including a laterally inner end. A left telescoping support assembly includes a laterally outer end connected to the left sideform assembly and a laterally inner end connected to the center portion laterally inward of the left lateral end. The left telescoping support assembly includes a left actuator for extending and retracting the left telescoping support assembly. A right telescoping support assembly includes a laterally outer end connected to the right sideform assembly and a laterally inner end connected to the center portion laterally inward of the right lateral end. The right telescoping support assembly includes a right actuator for extending and retracting the right telescoping support assembly. One or more left spacers are configured to be received between the laterally inner end of the left sideform assembly and the left lateral end of the center portion, such that upon retraction of the left telescoping support assembly a laterally innermost one of the one or more left spacers is held directly against the left lateral end of the center portion. One or more right spacers are configured to be received between the laterally inner end of the right sideform assembly and the right lateral end of the center portion, such that upon retraction of the right telescoping support assembly a laterally innermost one of the one or more right spacers is held directly against the right lateral end of the center portion.

In another embodiment an adjustable width mold apparatus for a slipform paver may include a center portion and left and right sideform assemblies. A left telescoping support assembly may include a laterally outer end connected to the left sideform assembly and a laterally inner end connected to the center portion. A left rotary spindle actuator for extending and retracting the left telescoping support assembly may include a left rotary spindle connected to one of the left sideform assembly and the center portion, and a left nut connected directly or indirectly to the other of the left sideform assembly and the center portion. The left rotary spindle may be received in the left nut. Similarly, a right telescoping support assembly may include a laterally outer end connected to the right sideform assembly and a laterally inner end connected to center portion. A right rotary spindle actuator may include a right rotary spindle connected to one of the right sideform assembly and the center portion and a right nut connected directly or indirectly to the other of the right sideform assembly and the center portion. The right rotary spindle may be received in the right nut. One or more spacers may be configured to be received between the sideform assemblies and the center portion to adjust the width of the mold apparatus.

In another embodiment an adjustable width mold apparatus for a slipform paver includes a center portion and left and right sideform assemblies. A left telescoping support assembly may include a laterally outer end connected to the left sideform assembly and a laterally inner end connected to the center portion. A left actuator may be provided for extending and retracting the left telescoping support assembly. A right telescoping support assembly may include a laterally outer end connected to the right sideform assembly and a laterally inner end connected to the center portion. A right actuator may be provided for extending and retracting the right telescoping support assembly. A plurality of left side hanger rods may extend between the left sideform assembly and the center portion, the left side hanger rods being separate from the left telescoping support assembly. One or more left side spacers may be configured to be received on the left side hanger rods between the left sideform assembly and the center portion.

In any of the above embodiments the laterally outer end of the left telescoping support assembly may be connected to the left sideform assembly laterally outward of the laterally inner end of the left sideform assembly.

In any of the above embodiments, upon retraction of the left telescoping support assembly a laterally outermost one of the one or more left spacers may be held directly against the laterally inner end of the left sideform assembly.

In any of the above embodiments the left telescoping support assembly may further include a forward left telescoping tube assembly and a rearward left telescoping tube assembly. The forward left telescoping tube assembly includes a male tube connected to one of the left sideform assembly and the center portion, and a female tube connected to the other of the left sideform assembly and the center portion. The rearward left telescoping assembly includes a male tube connected to one of the left sideform assembly and the center portion, and a female tube connected to the other of the left sideform assembly and the center portion.

In any of the above embodiments the left telescoping support assembly may further include a bridge structurally connecting the female tubes of the forward and rearward left telescoping tube assemblies.

In any of the above embodiments the male tubes may be connected to the left sideform assembly and the female tubes may be connected to the center portion.

In any of the above embodiments the left actuator may be connected between the left sideform assembly and the bridge.

In any of the above embodiments the left actuator may include a rotary spindle connected to the left sideform assembly and nut connected to the bridge, the rotary spindle being received in the nut.

In any of the above embodiments the left actuator may include a rotary spindle connected to one of the left sideform assembly and the center portion, and a nut connected to the other of the left sideform assembly and the center portion, the rotary spindle being received in the nut.

In any of the above embodiments the laterally inner end of the left telescoping support assembly may be mounted on the center portion at a mounting location at least mid-way from the left lateral end of the center portion toward a lateral center of the center portion.

In any of the above embodiments the center portion may include a left center portion half and a right center portion half joined together by a pivoted connection such that the left and right center portion halves can be pivoted relative to each other to form a crown in the molded structure.

In any of the above embodiments the apparatus may further comprise a plurality of left side hanger rods extending between the left sideform assembly and the center portion, the left side hanger rods being separate from the left telescoping support assembly. One or more left spacers may be configured to be received on the left side hanger rods between the left sideform assembly and the center portion.

In any of the above embodiments the plurality of left side hanger rods may include a forward upper hanger rod, a forward lower hanger rod, a rearward upper hanger rod, and a rearward lower hanger rod.

In any of the above embodiments each of the one or more left spacers may include a forward spacer portion including an at least partially vertical upper slot for hanging the forward spacer portion on the forward upper hanger rod, and including an at least partially horizontal lower slot for receiving the forward lower hanger rod when the forward spacer portion is swung into a substantially vertical orientation after being hung on the forward upper hanger rod. The spacer may include a rearward spacer portion including an at least partially vertical upper slot for hanging the rearward spacer portion on the rearward upper hanger rod, and including an at least partially horizontal lower slot for receiving the rearward lower hanger rod when the rearward spacer portion is swung into a substantially vertical orientation after being hung on the rearward upper hanger rod. The spacer may include upper and lower length adjustable connectors connecting the ends of the forward and rearward spacer portions. A pan may be connected to the lower ends of the forward and rearward spacer portions.

In any of the above embodiments the left telescoping support assembly may include a forward left telescoping tube assembly and a rearward left telescoping tube assembly, each including a male tube and a female tube. In a lateral end view the plurality of left side hanger rods may define corners of an imaginary border, and center axes of the forward and rearward left telescoping tube assemblies and of the left actuator may all lie within the imaginary border.

In any of the above embodiments each of the left side hanger rods may be fixedly attached to the left sideform assembly and may be slidably received through an opening in the left lateral end of the center portion. Each of the right side hanger rods may be fixedly attached to the right sideform assembly and may be slidably received through an opening in the right lateral end of the center portion.

One advantage of the adjustable width paver apparatus disclosed herein is that an especially compact construction is provided by connecting the laterally outer ends of the telescoping support assemblies internally within the sideform assemblies laterally outward of the laterally inner ends of the sideform assemblies, and by connecting the laterally inner ends of the telescoping support assemblies to the center portion laterally inward of the lateral ends of the center portion.

Another advantage is the simple construction of the hanger rod system, which allows the telescoping support assemblies to be constructed from simple round tubes. This is contrasted for example to a system like that of Guntert U.S. Pat. No. 7,950,874 where the spacers are hung from specially constructed outer tubes having ledges formed in the tubes.

A further advantage is provided by the use of rotary spindle actuators which provide an especially fine control over the extension and retraction of the sideform assemblies.

Numerous other objects, features and advantages of the embodiments set forth herein will be readily apparent to those skilled in the art upon reading of the following disclosure when taken in conjunction with the accompanying drawings.

DETAILED DESCRIPTION

Figure 1:
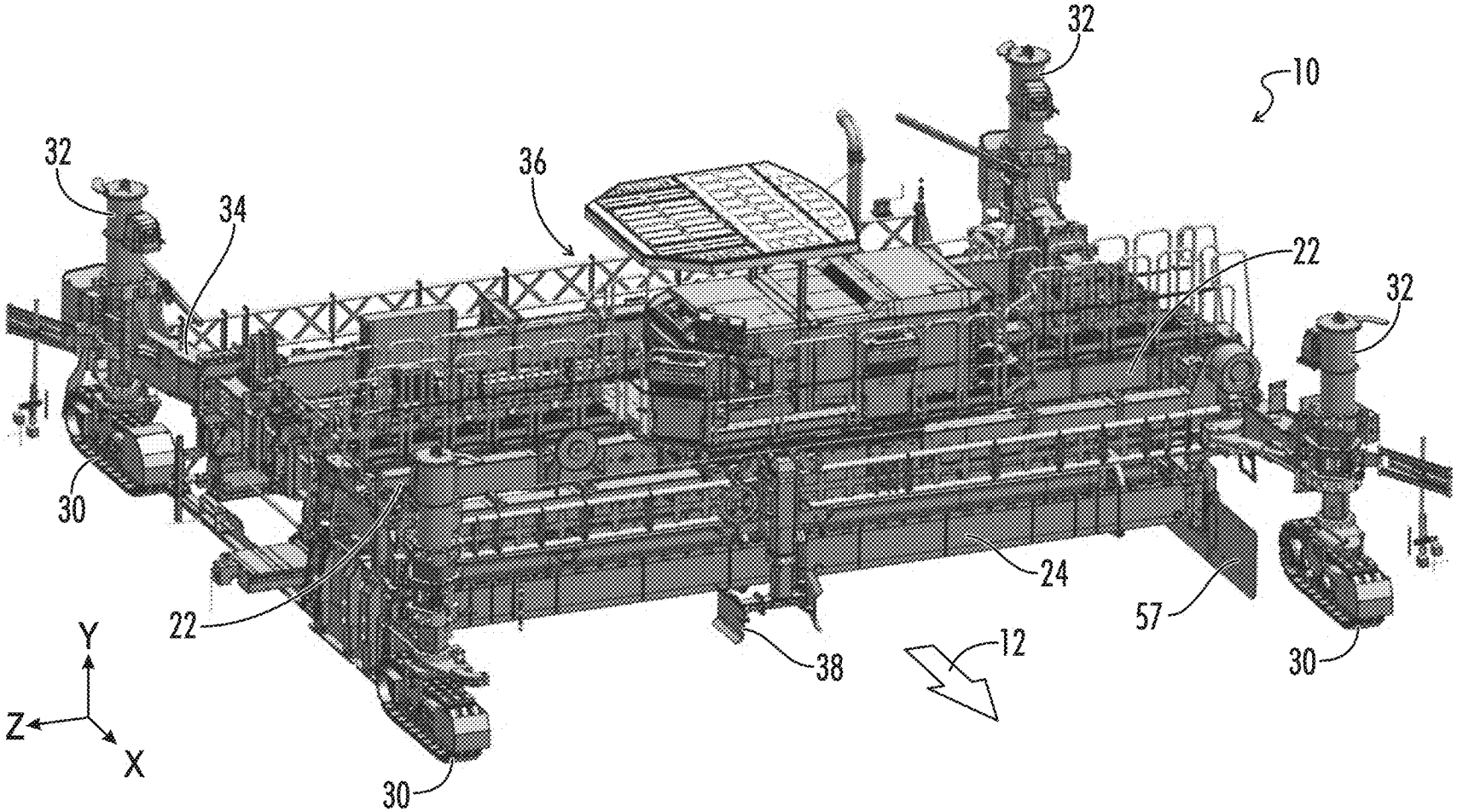
FIG. 1 is a front perspective view of a slipform paver including the adjustable width mold apparatus.
Figure 2:
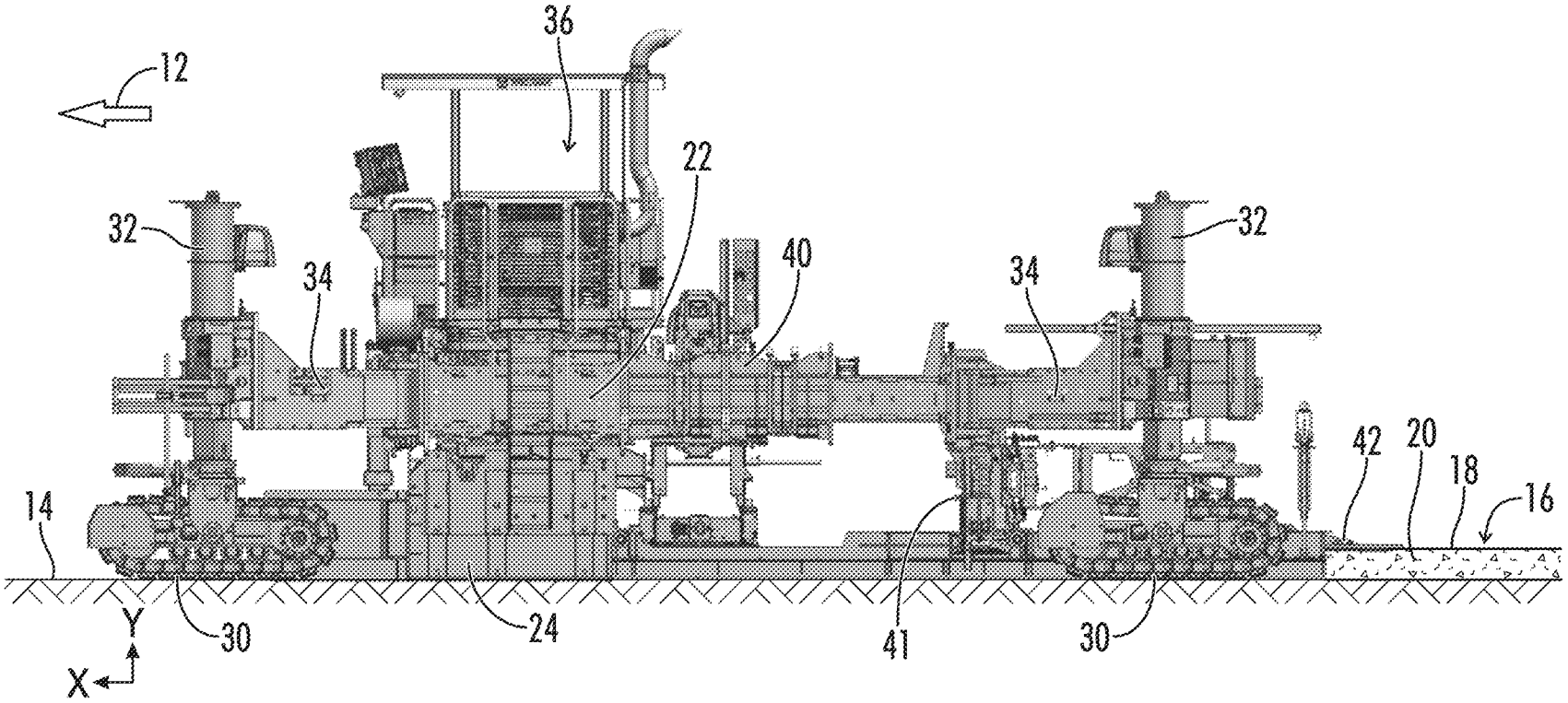
FIG. 2 is a left side elevation view of the slipform paver of FIG. 1.
Figure 3:
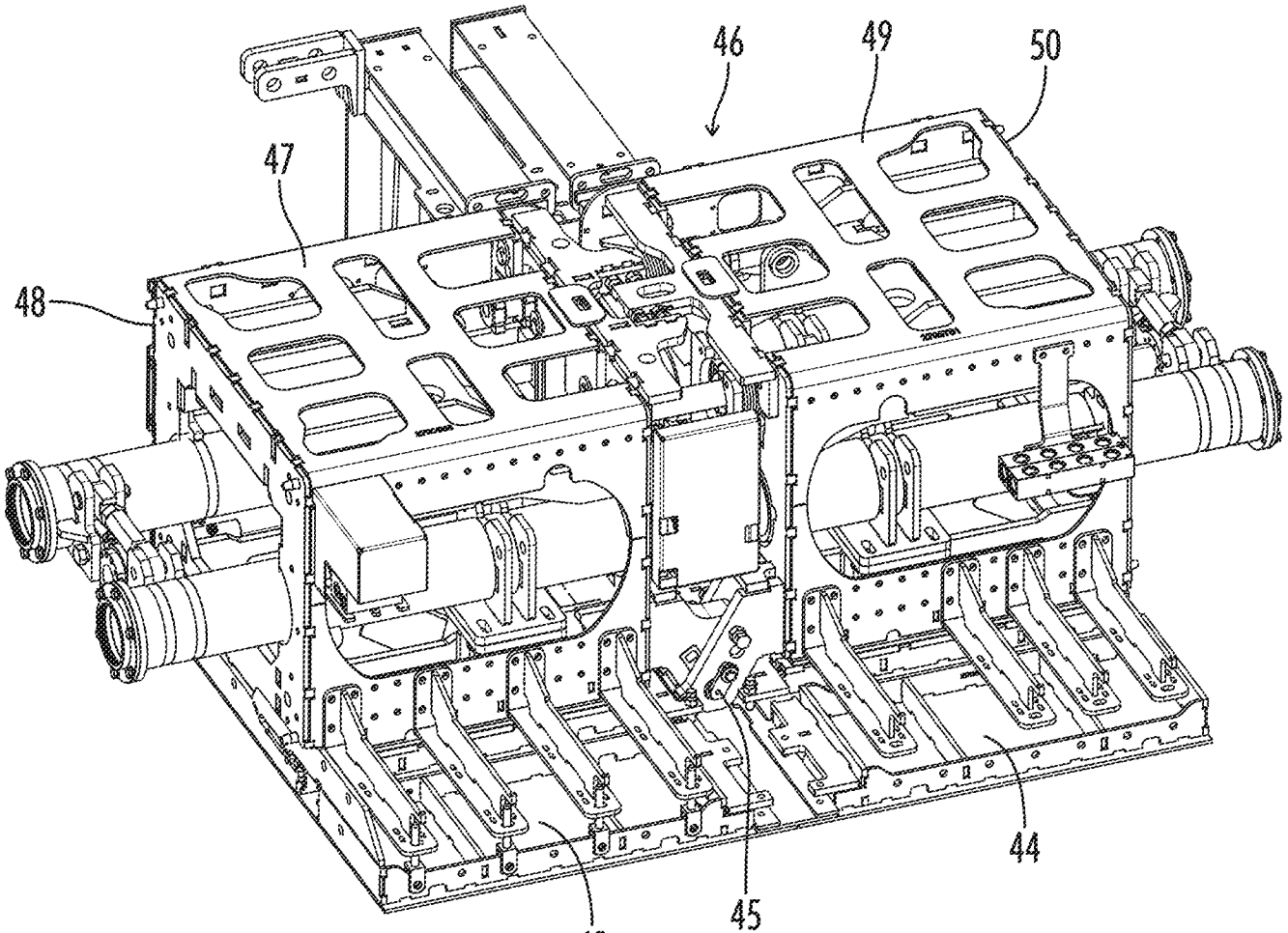
FIG. 3 is an enlarged view of the center portion of the adjustable width mold apparatus.

Referring now to the drawings, and particularly to FIGS. 1 and 2, a slipform paver apparatus is shown and generally designated by the number 10. The details of construction of a typical slipform paver apparatus may be seen in U.S. Pat. No. 6,872,028 (WO 2002/101150) to Aeschlimann et al., which is incorporated herein by reference.

As is schematically illustrated in FIGS. 1 and 2 the apparatus 10 is configured to move in a paving direction 12 across a ground surface 14 for spreading, leveling and finishing concrete into a finished concrete structure 16 having a generally upwardly exposed concrete surface 18 and terminating in lateral concrete sides such as 20.

The slipform paver apparatus 10 includes a main frame 22 and a slipform paver mold 24 supported from the main frame 22. The slipform paver mold 24 may be referred to as an adjustable width mold apparatus 24.

The main frame 22 is supported from the ground surface by a plurality of ground engaging units such as 30, which in the illustrated embodiment are tracked ground engaging units 30. Wheeled ground engaging units could also be used. Each of the ground engaging units 30 is connected to the main frame 22 by a lifting column such as 32 which may be attached to a swing arm such as 34. An operator's platform 36 is located on the main frame 22. A plow or spreader device 38 may be supported from the main frame 22 ahead of the slipform paver mold 24. Behind the slipform paver mold 24 a dowel bar inserter apparatus 40 may be provided. Behind the dowel bar inserter apparatus 40 an oscillating beam 41 and a super smoother apparatus 42 may be provided.

The main frame 22 includes a plurality of laterally telescoping frame members that allow the width of the main frame to be adjusted. The adjustment of the main frame width may be accomplished using hydraulic ram actuators embedded in the main frame, or the traction power of the ground engaging units 30 may be used to extend and retract the main frame 22. When the width of the main frame 22 is adjusted it may also be necessary to adjust the width of the mold apparatus 24.

Figure 4:
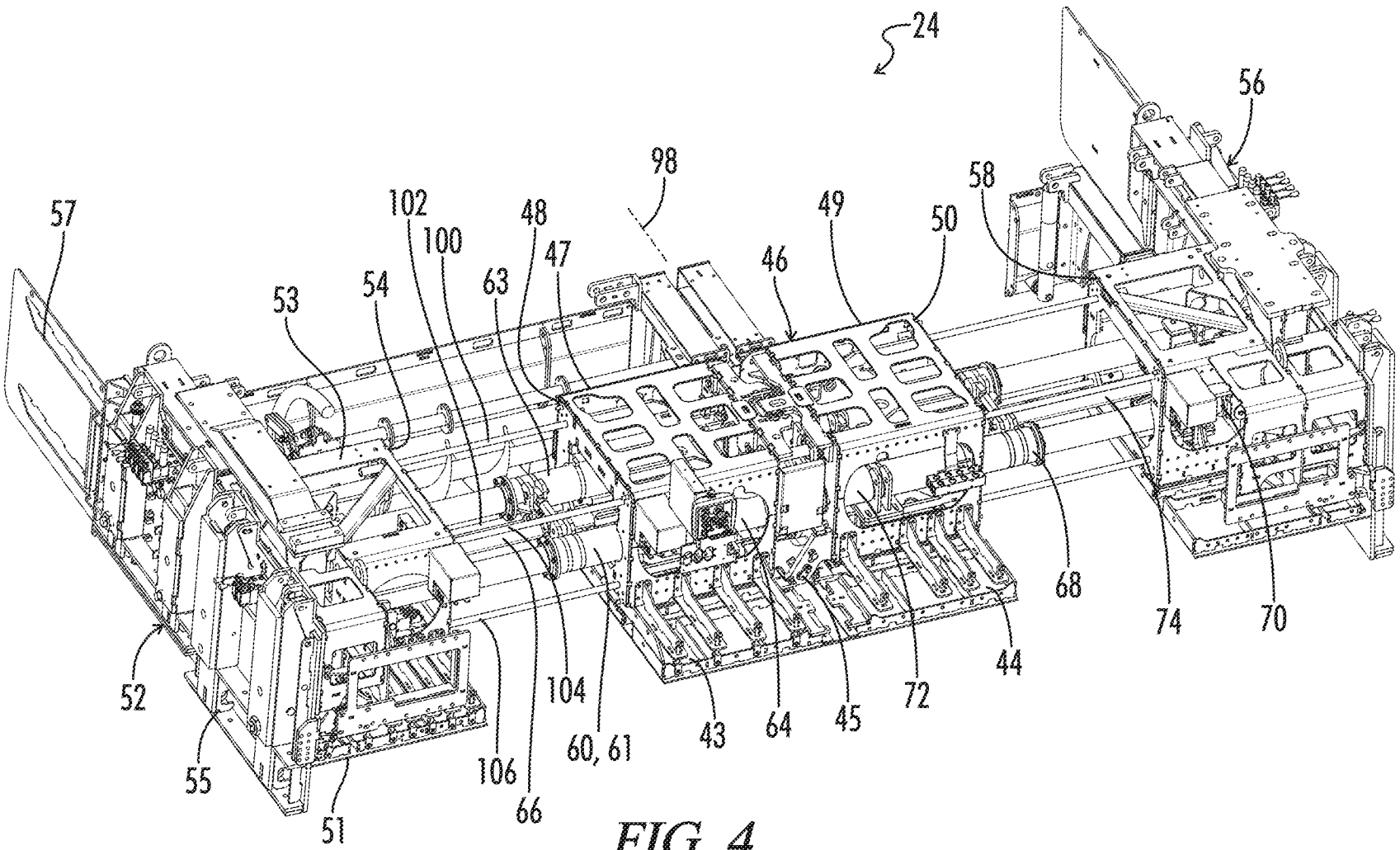
FIG. 4 is a rear left side perspective view of the adjustable width mold apparatus, with each of the sideform assemblies in an extended position providing a space to receive one or more spacers.
Figure 6:
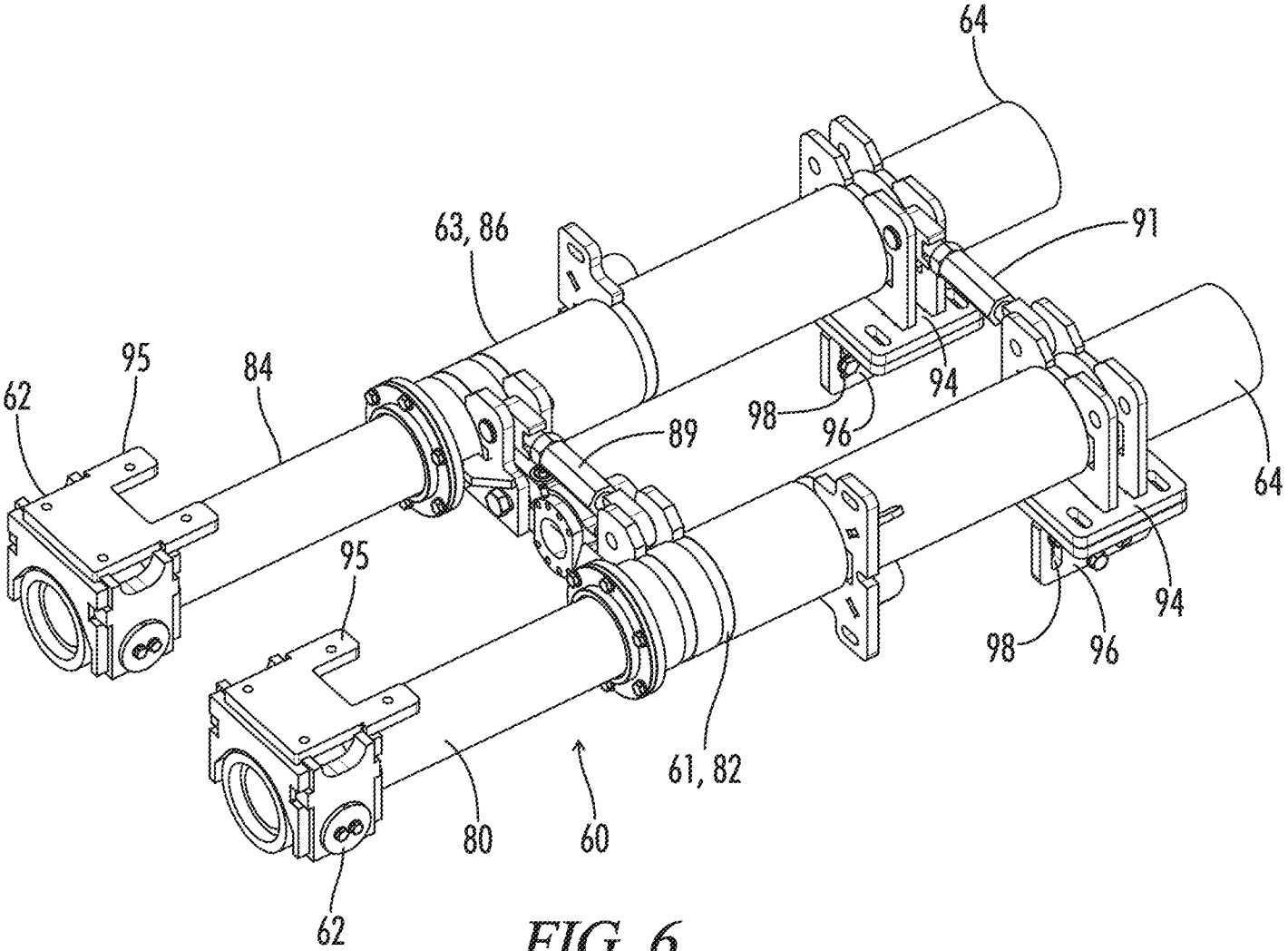
FIG. 6 is a perspective view of the left telescoping support assembly.

Referring now to FIGS. 4 and 6 the adjustable width mold apparatus 24 includes a center portion 46 terminating in left and right lateral ends 48 and 50. The center portion 46 may be of the type configured to allow the formation of a crown in the molded concrete structure 16. In such an embodiment, the center portion 46 includes a left center portion half 47 and a right center portion half 49 joined together by a pivoted connection 45 such that the left and right center portion halves 47 and 49 can be pivoted relative to each other to form a crown in the molded structure 16. Left and right center portion pan portions 43 and 44 are attached to the bottom of the left and right center portion halves 47 and 49 and define the center portion of the generally horizontal mold surface for forming the top surface 18 of the molded concrete structure 16.

The adjustable width mold apparatus 24 further includes a left sideform assembly 52 having a laterally inner end 54 and a right sideform assembly 56 having a laterally inner end 58.

The left sideform assembly 52 may include a sideform framework 53 on which the laterally inner end 54 is defined. A left sideform assembly pan portion 51 is attached to the bottom of the sideform framework 53 and defines the leftmost portion of the generally horizontal mold surface for forming the top surface 18 of the molded concrete structure 16. The left sideform assembly 52 may further include a left sideform 55 which extends vertically downward from the sideform framework 53 to seal the left end of the mold and thus to form the left wall 20 of the molded structure 16. A guide panel 57 may extend forward from the sideform 55 to guide the unformed concrete mixture into the mold. The right sideform assembly 56 is similarly constructed.

A left telescoping support assembly 60 is connected between the left sideform assembly 52 and the center portion 46. FIG. 4 shows the left telescoping support assembly 60 in place on the mold apparatus 24, and FIG. 6 shows the left telescoping support assembly 60 in isolation. The left telescoping support assembly 60 includes a laterally outer end 62 connected to the left sideform assembly 52 and a laterally inner end 64 connected to the center portion 46 laterally inward of the left lateral and 48. Preferably the laterally outer end 62 of the left telescoping support assembly 60 is connected to the left sideform assembly 52 laterally outward of the laterally inner end 54 of the left sideform assembly 52.

The laterally inner end 64 of the left telescoping support assembly 60 may be mounted upon the center portion 46 using horizontal mounting plates such as 94 and vertical mounting plates such as 96 extending downward from the horizontal plates 94. Holes 98 in the vertical mounting plates 96 may receive bolts (not shown) to fixedly attach the left telescoping support assembly 60 to the center portion 46 at a mounting location. The mounting location is preferably at least midway from the left lateral end 48 of the center portion 46 toward a lateral center 101 of the center portion 46.

Figure 7:
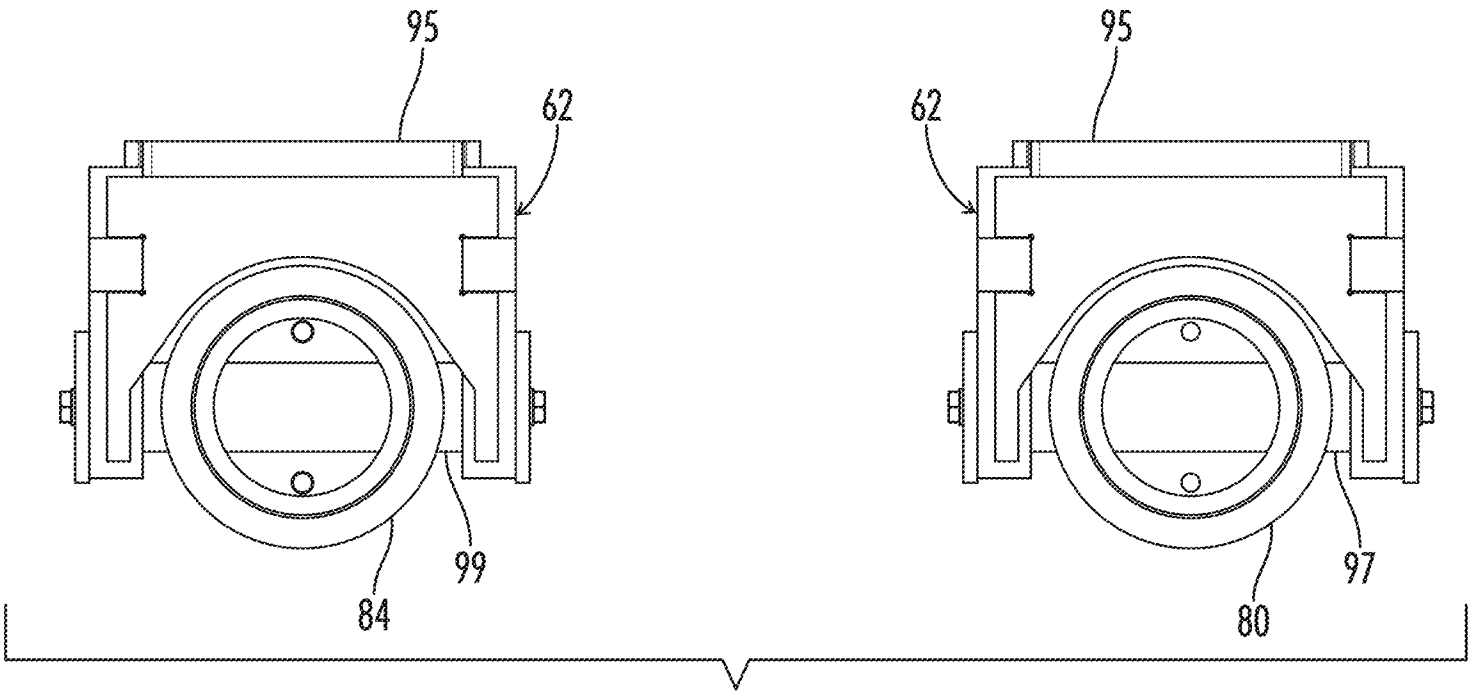
FIG. 7 is a laterally outer end view of the connecting portions of the left telescoping support assembly.

The laterally outer end 62 of the left telescoping support assembly 60 is mounted upon the left sideform assembly 52 using mounting flanges such as 95 which may be bolted to a corresponding surface on the left sideform assembly 52. FIG. 7 is a left end view of the laterally outer ends of the left telescoping support assembly 60. There it can be seen that the mounting flanges 95 are pivotally connected to their respective male tubes 80 and 84 via pivot pins 97 and 99.

The left telescoping support assembly 60 includes a left actuator 66 for extending and retracting the left telescoping support assembly 60 so as to move the left sideform assembly 52 away from or toward the center portion 46.

A right telescoping support assembly 68 similarly includes a laterally outer end 70 connected to the right sideform assembly 56 and a laterally inner end 72 connected to the center portion 46 laterally inward of the right lateral end 50. Preferably the laterally outer end 70 of the right telescoping support assembly 68 is connected to the right sideform assembly 56 laterally outward of the laterally inner end 58 of the right sideform assembly 56. The right telescoping support assembly 68 includes a right actuator 74 for extending and retracting the right telescoping support assembly 68. The extension of the left and right telescoping support assemblies can also be aided by use of the ground engaging units 30. The left and right telescoping support assemblies 60 and 68 may also be referred to as left and right adjustable width support assemblies 60 and 68.

Figure 5:
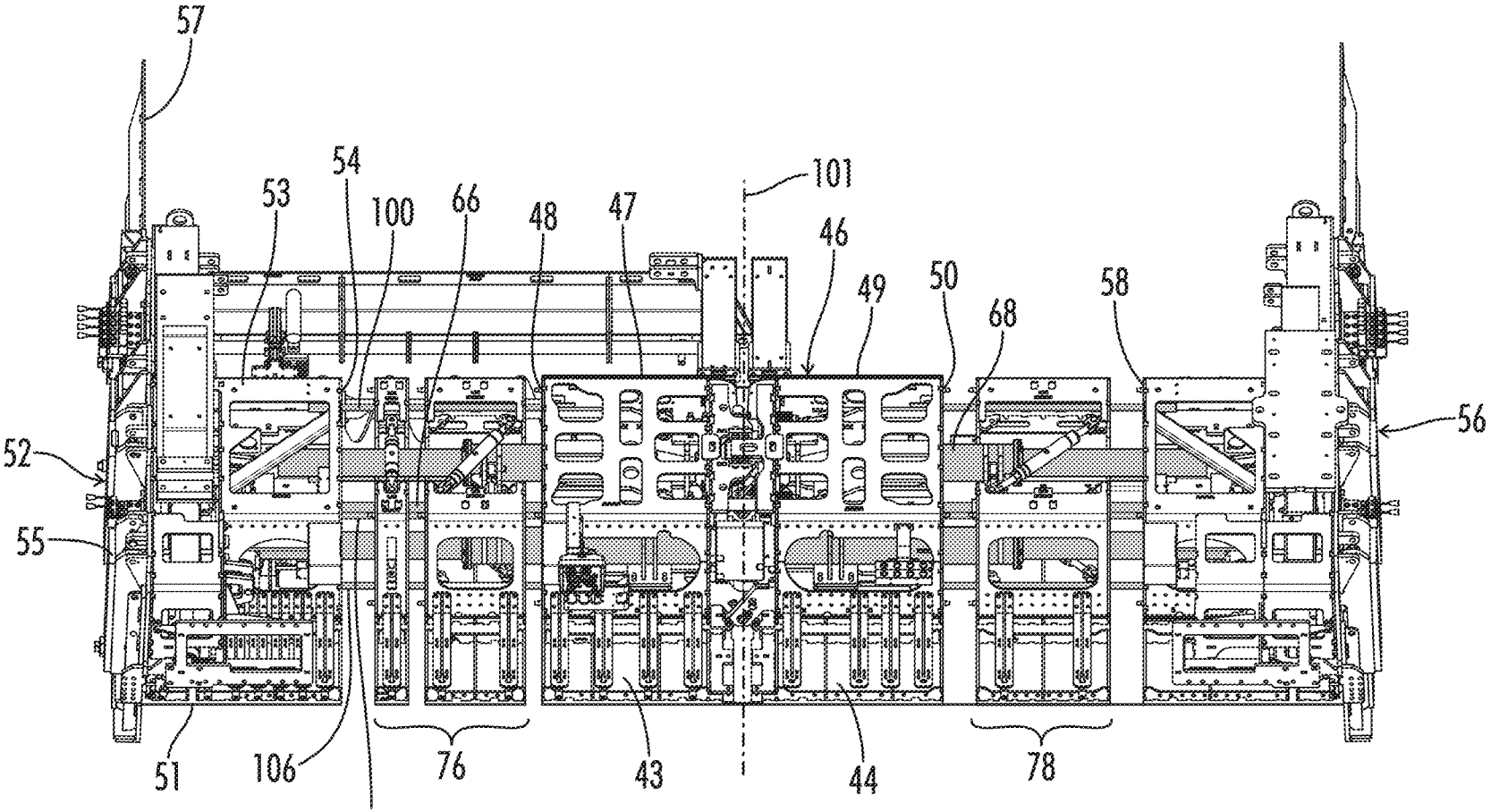
FIG. 5 is rear perspective view of the adjustable width mold apparatus of FIG. 4, showing two spacers inserted on the left side and one spacer inserted on the right side. The sideform assemblies have not yet been retracted to clamp the spacers in place.

As seen in FIG. 5 one or more left spacers 76 are configured to be received between the laterally inner end 54 of the left sideform assembly 52 and the left lateral end 48 of the center portion 46, such that upon retraction of the left telescoping support assembly 60 a laterally innermost one of the one or more left spacers 76 is held directly against the left lateral end 48 of the center portion 46. Similarly, upon retraction of the left telescoping support assembly 60 a laterally outermost one of the one or more left spacers 76 is held directly against the laterally inner end 54 of the left sideform assembly 52.

Similarly, one or more right spacers 78 are configured to be received between the laterally inner end 58 of the right sideform assembly 56 and the right lateral end 50 of the center portion 46, such that upon retraction of the right telescoping support assembly 68 a laterally innermost one of the one or more right spacers 78 is held directly against the right lateral end 50 of the center portion 46. Similarly, upon retraction of the right telescoping support assembly 68 a laterally outermost one of the one or more right spacers 78 is held directly against the laterally inner end 58 of the right sideform assembly 56.

The left telescoping support assembly 60 includes a rearward left telescoping tube assembly 61 and a forward left telescoping tube assembly 63. The forward left telescoping tube assembly 63 includes a male tube 84 connected to one of the left sideform assembly 52 and the center portion 46, and a female tube 86 connected to the other of the left sideform assembly 52 and the center portion 46. Similarly, the rearward left telescoping tube assembly 61 includes a male tube 80 connected to one of the left sideform assembly 52 and the center portion 46, and female tube 82 connected to the other of the left sideform assembly 52 and the center portion 46. Preferably it is the male tubes 80 and 84 which are connected to the left sideform assembly 52, and the female tubes 82 and 86 which are connected to the center portion 46.

Figure 8:
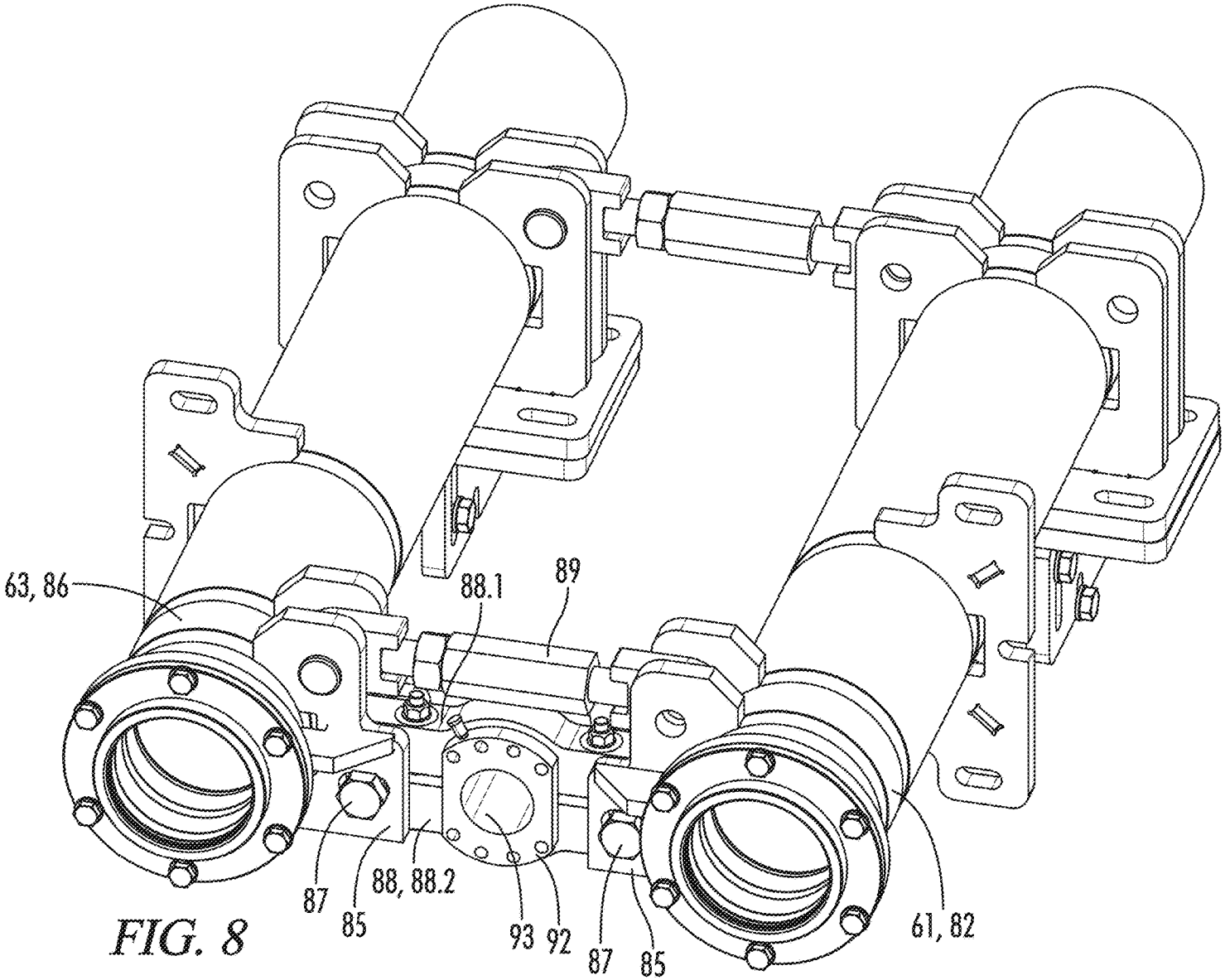
FIG. 8 is a perspective view of the laterally outer ends of the female tubes of the left telescoping support assembly, showing the bridge and the nut mounted in the bridge.

The left telescoping support assembly 60 further includes a bridge 88 best seen in FIG. 8. The bridge 88 structurally connects the female tubes 82 and 86 of the forward and rearward left telescoping tube assemblies 61 and 63. The bridge 88 may be attached to the female tubes 82 and 86 via bolts 87 extending through brackets 85 which are welded to the female tubes. The left telescoping support assembly 60 may further include first and second adjustable length connectors 89 and 91 extending between the female tubes 82 and 86 as seen in FIG. 6.

Figure 9:
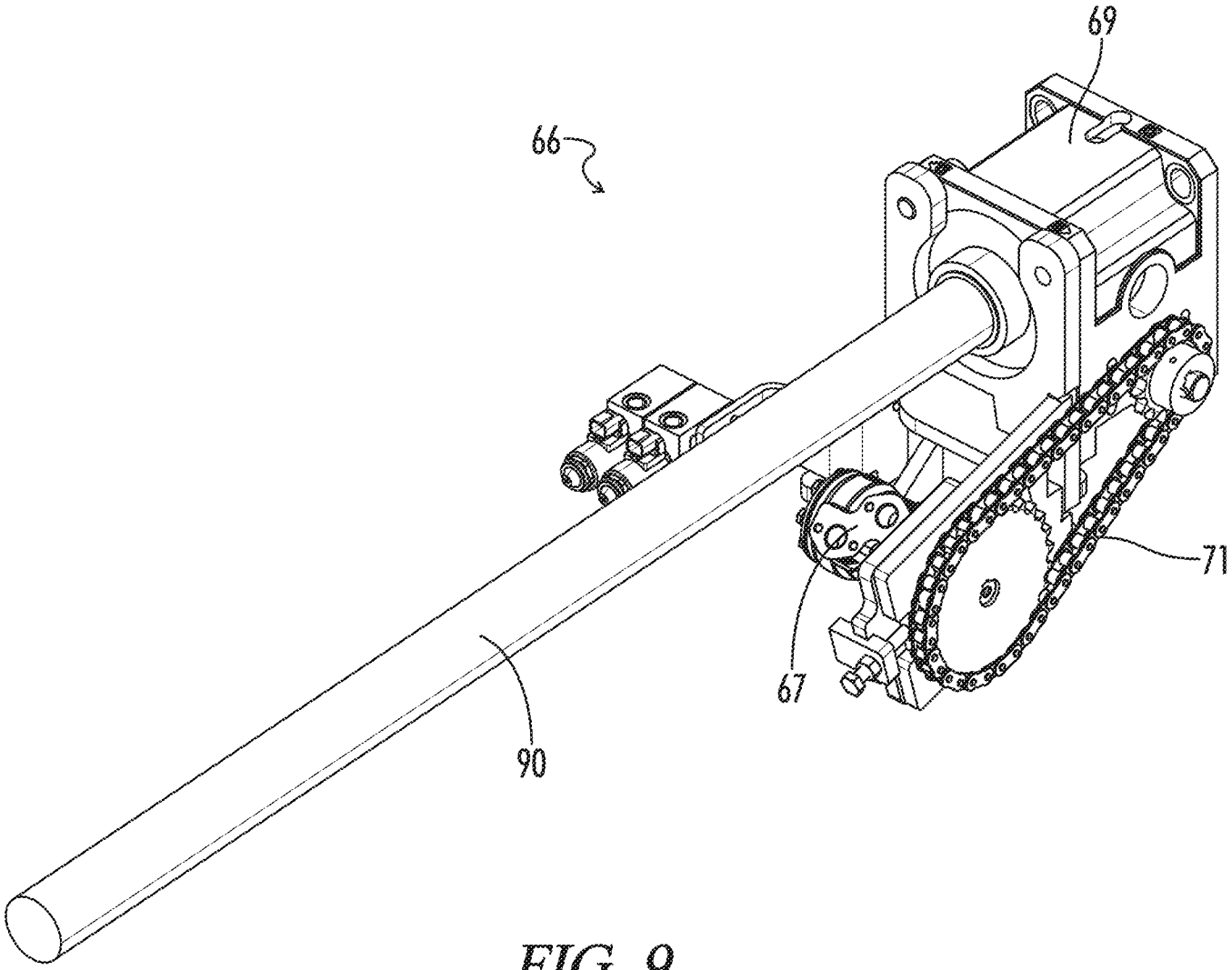
FIG. 9 is a perspective view of the left rotary spindle actuator.
Figure 10:
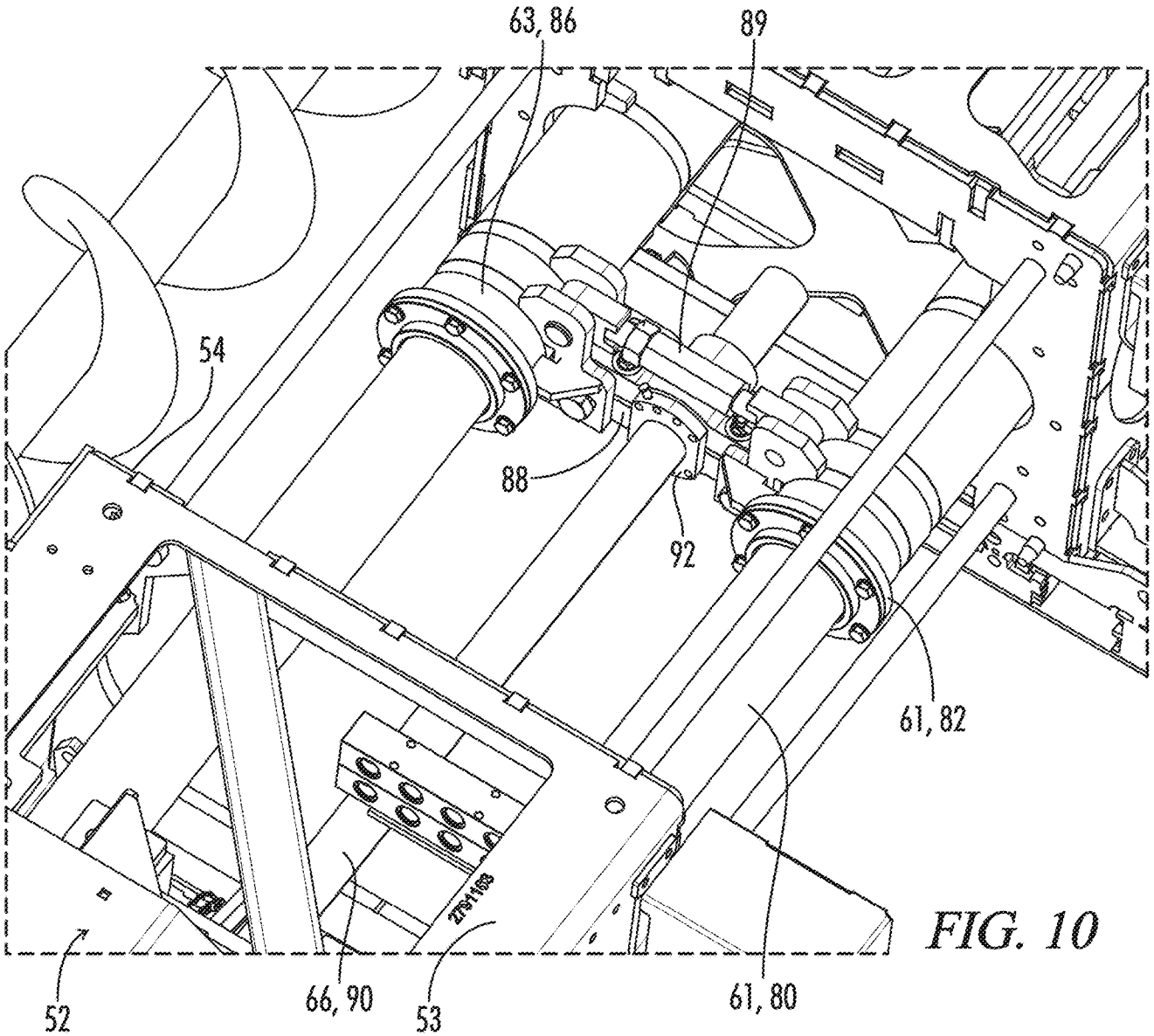
FIG. 10 is a perspective view showing the left rotary spindle actuator engaged with the left nut.

The left actuator 66, which is best seen in FIG. 9 in isolated view, is preferably a rotary spindle type actuator including a rotary spindle 90 which is threadably received in a threaded bore 93 of a left nut 92 as best seen in FIG. 10. It is noted that the external surface of the rotary spindle 90 is threaded, but the threads are not shown in the drawing. The left nut 92 is mounted in the bridge 88 between upper and lower bridge portions 88.1 and 88.2. As is further apparent in FIG. 10, the rotary spindle 90 of the left actuator 66 is connected to the left nut and thus to the bridge 88.

More generally, the left actuator 66 can be described as having a rotary spindle 90 connected to one of the left sideform assembly 52 and the center portion 48, and a nut 92 connected to the other of the left sideform assembly 52 and the center portion 48, with the rotary spindle 90 being received in the nut 92.

The left actuator 66 may be hydraulically actuated via a hydraulic motor 67 which drives a gearbox 69 via a chain and sprocket drive 71. The gearbox 69 may be mounted on the sideform framework 53 via bolts (not shown).

As can be seen for example in FIG. 10 and FIG. 11 A, the one or more left spacers 76 are supported on a plurality of left side hanger rods, including a forward upper hanger rod 100, a forward lower hanger rod 102, a rearward upper hanger rod 104, and a rearward lower hanger rod 106. The left side hanger rods 100-106 extend between the left sideform assembly 52 and the center portion 46. The left side hanger rods 100-106 are completely separate from the left telescoping support assembly 60.

Figure 13:
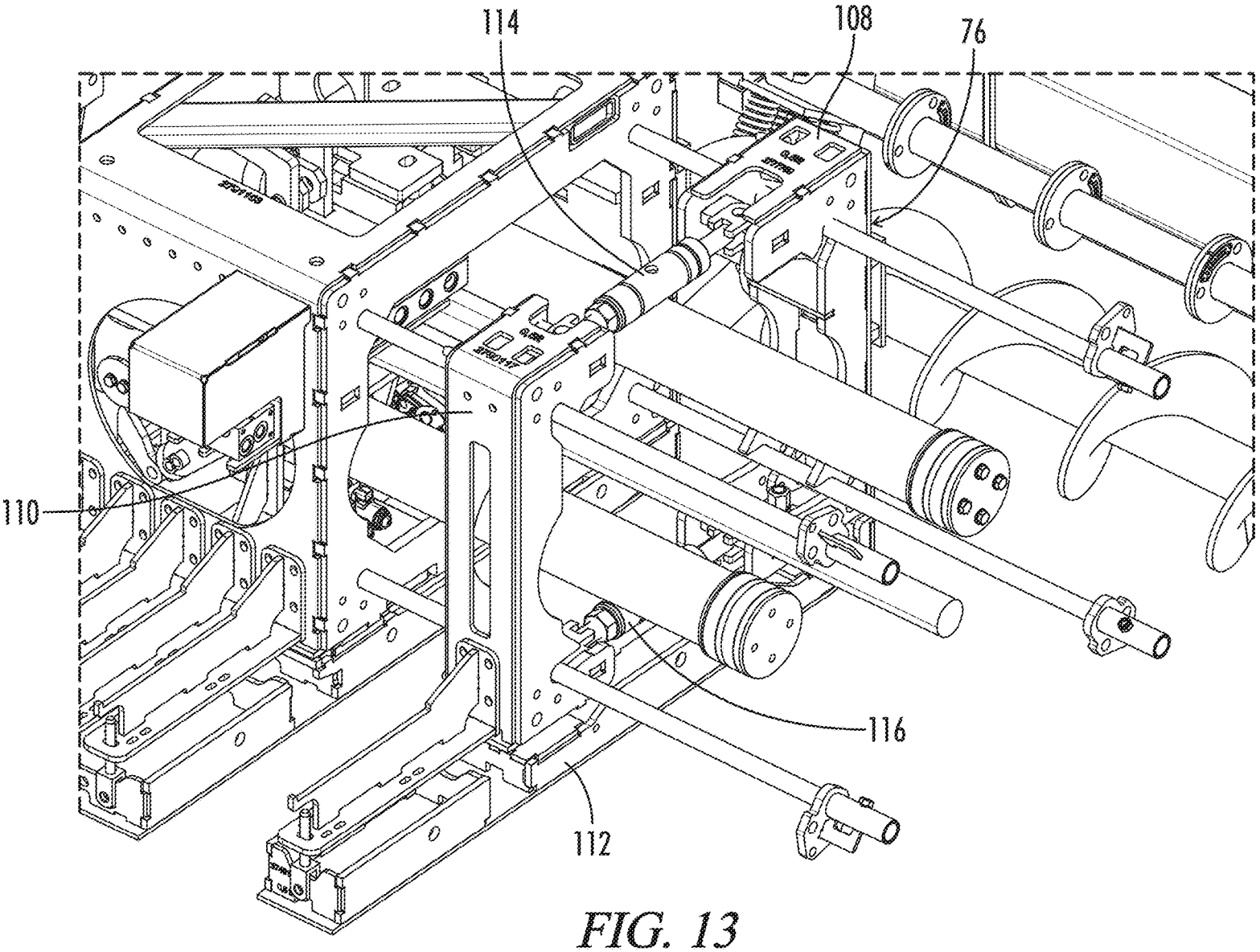
FIG. 13 is a perspective view showing the assembled and installed spacer of FIGS. 11C and 12C.

As is best seen for example in FIG. 13 each of the left side spacers 76 includes a forward spacer portion 108, a rearward spacer portion 110, a pan or wear plate 112, an upper adjustable length connector 114 and a lower adjustable length connector 116. The upper and lower adjustable length connectors 114 and 116 may for example be turnbuckles.

Figure 11A:
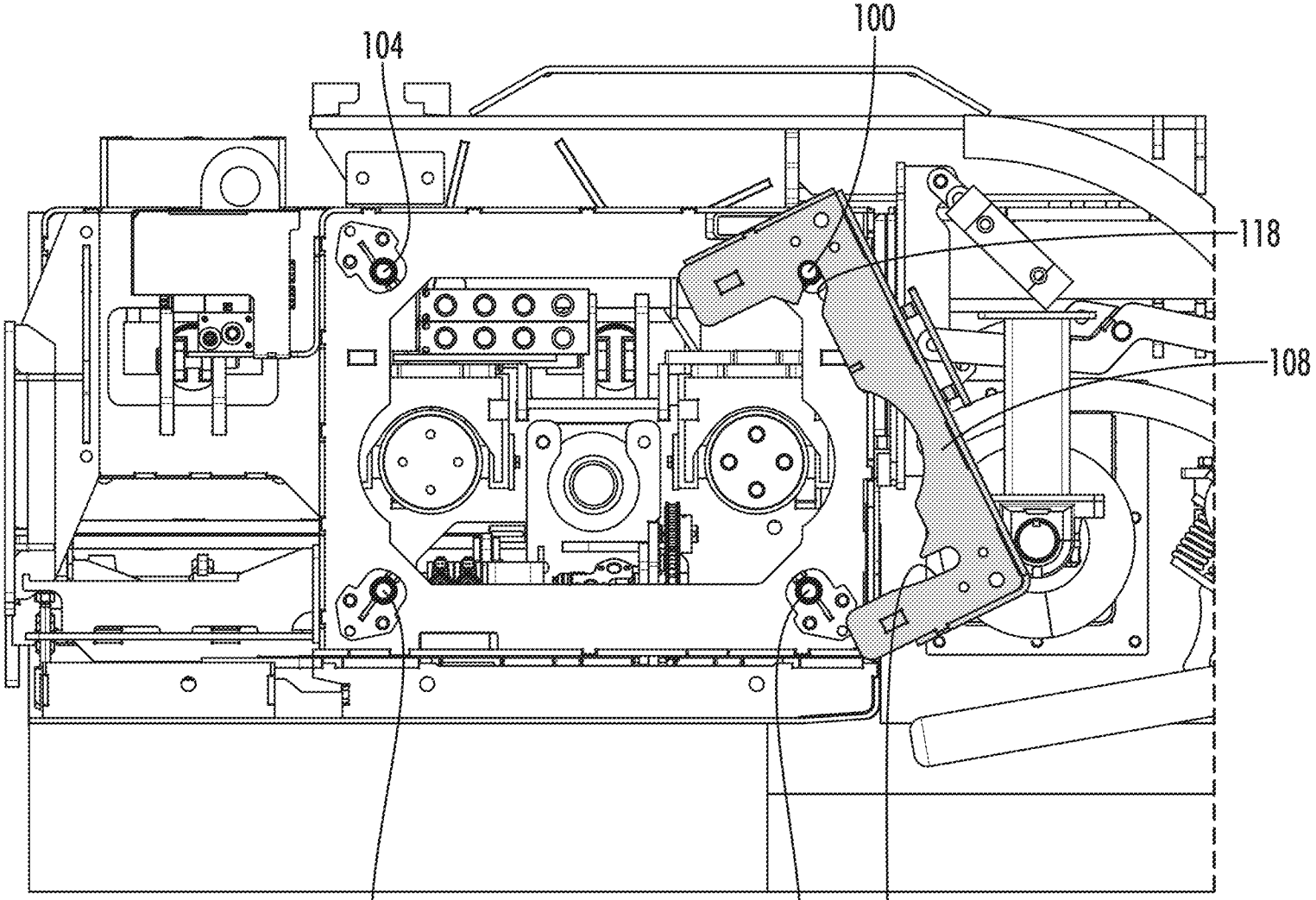
FIGS. 11A, 11B and 11C comprise a sequence of views showing the installation of a forward spacer portion or forward spacer frame.
Figure 11B:
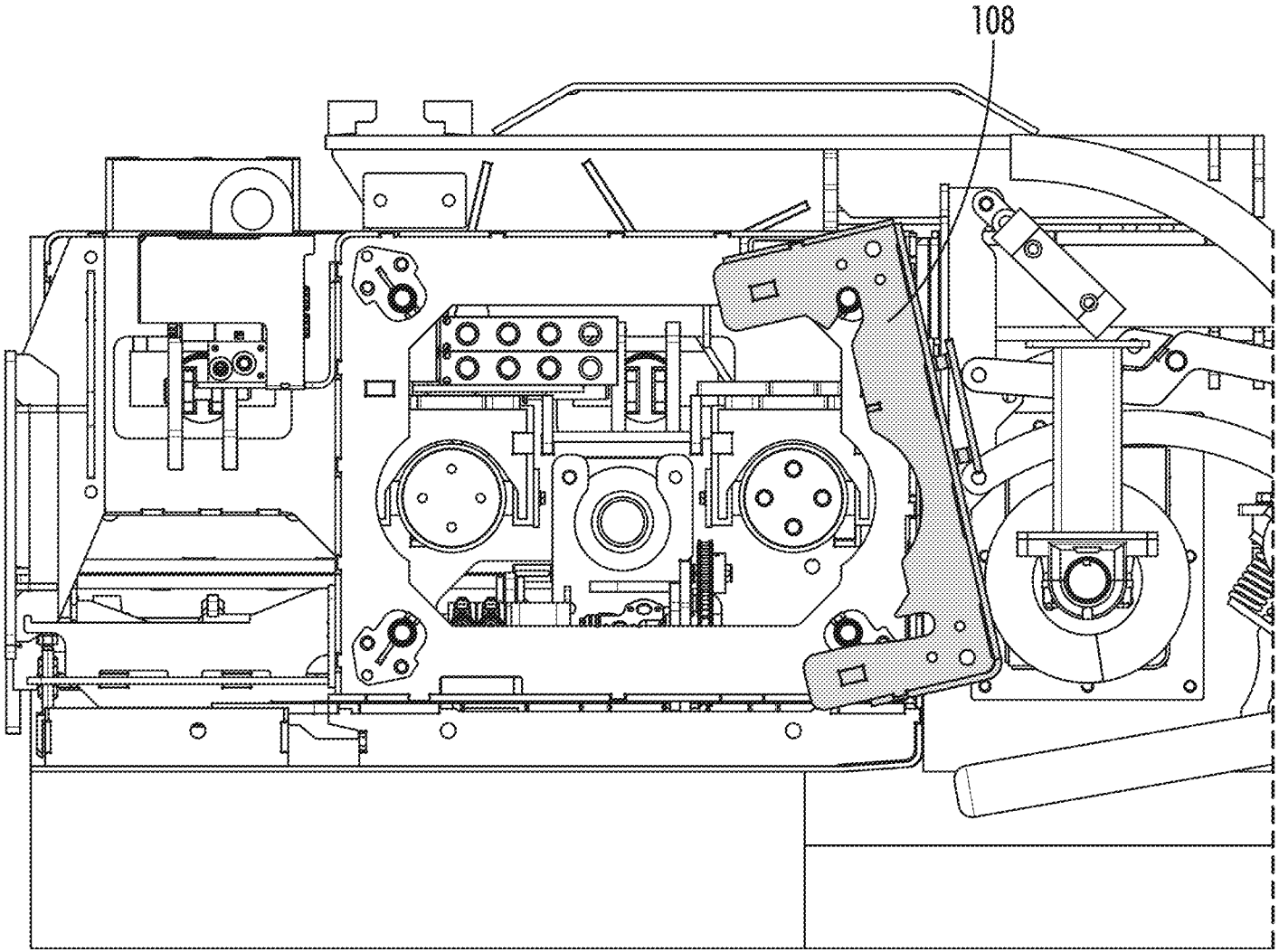
Figure 11C:
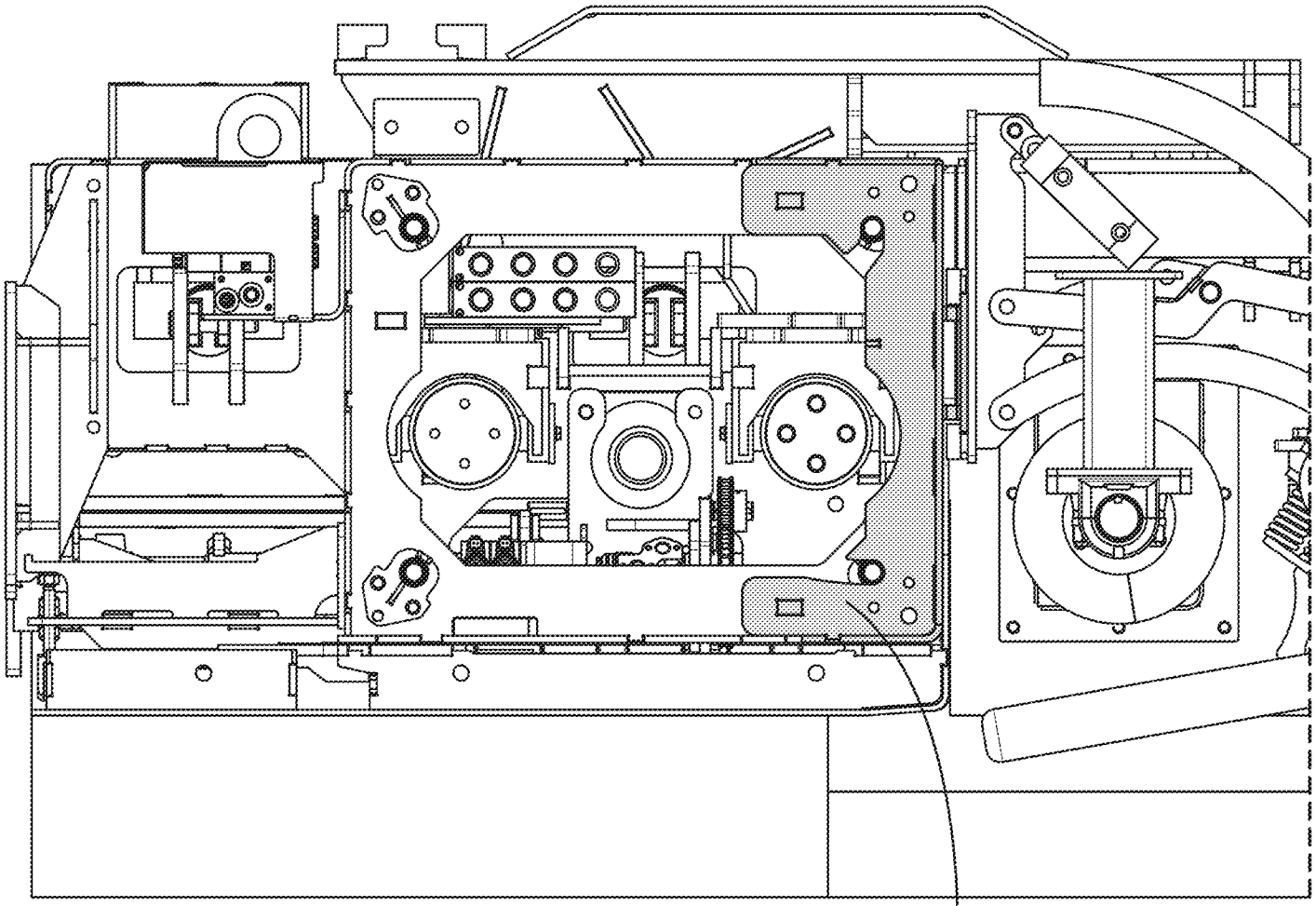

FIGS. 11 A-11 C show a sequential series of steps of installing the forward spacer portion 108 of one of the left side spacers 76 upon the forward hanger rods 100 and 102. The forward spacer portion 108 includes an upper slot 118 at least a portion of which is substantially vertical. The slot 118 may be described as an at least partially vertical upper slot 118 for hanging the forward spacer portion 108 on the forward upper hanger rod 100 as seen in FIG. 11 A. The forward spacer portion 108 further includes a lower slot 120 at least a portion of which is horizontal for receiving the forward lower hanger rod 102 when the forward spacer portion 108 is swung into a substantially vertical orientation as seen in FIG. 11C after being hung on the forward upper hanger rod 100. The sequential series of FIGS. 11A-11C first shows the forward spacer portion 108 with its lower end tilted forward and with the upper slot 118 being fitted over the forward upper hanger rod 100. Then the forward spacer portion 108 is pivoted clockwise about the forward upper hanger rod 100 through the position of FIG. 11B to the final position of FIG. 11C wherein the forward lower hanger rod 102 is received in the horizontal portion of the lower slot 120.

Figure 12A:
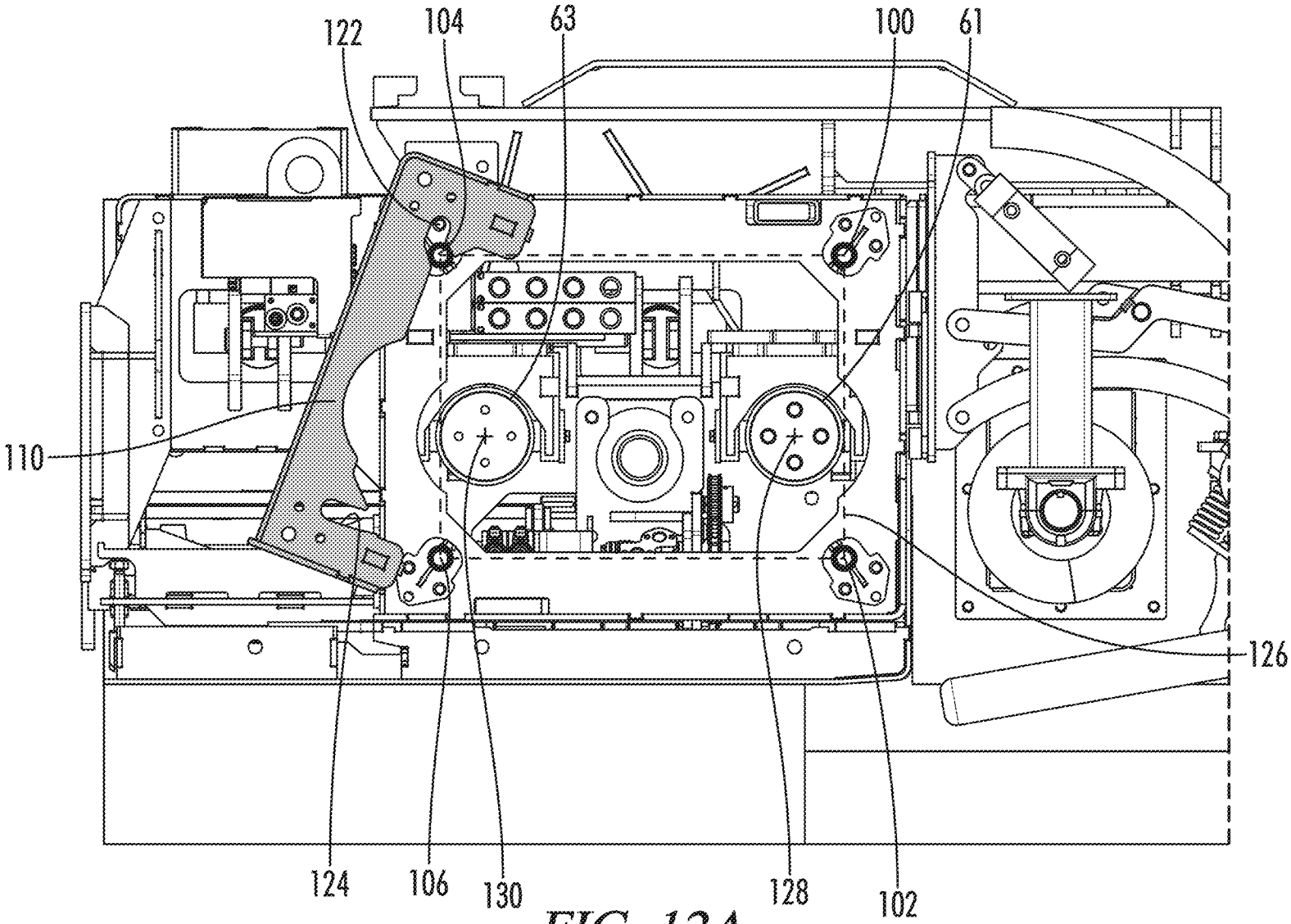
FIGS. 12A, 12B and 12C comprise a sequence of views showing the installation of a rearward spacer portion or rearward spacer frame.
Figure 12B:
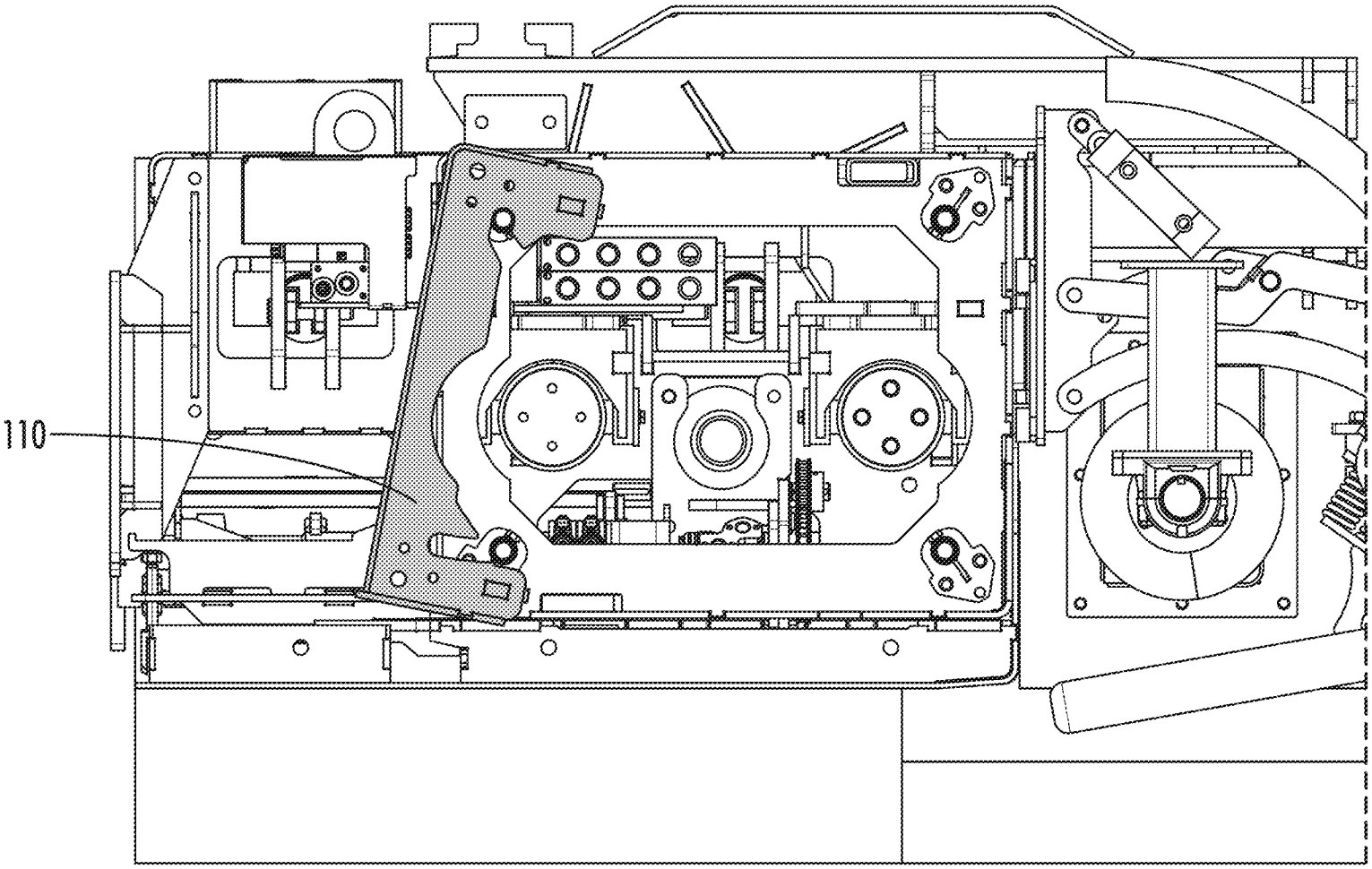
Figure 12C:
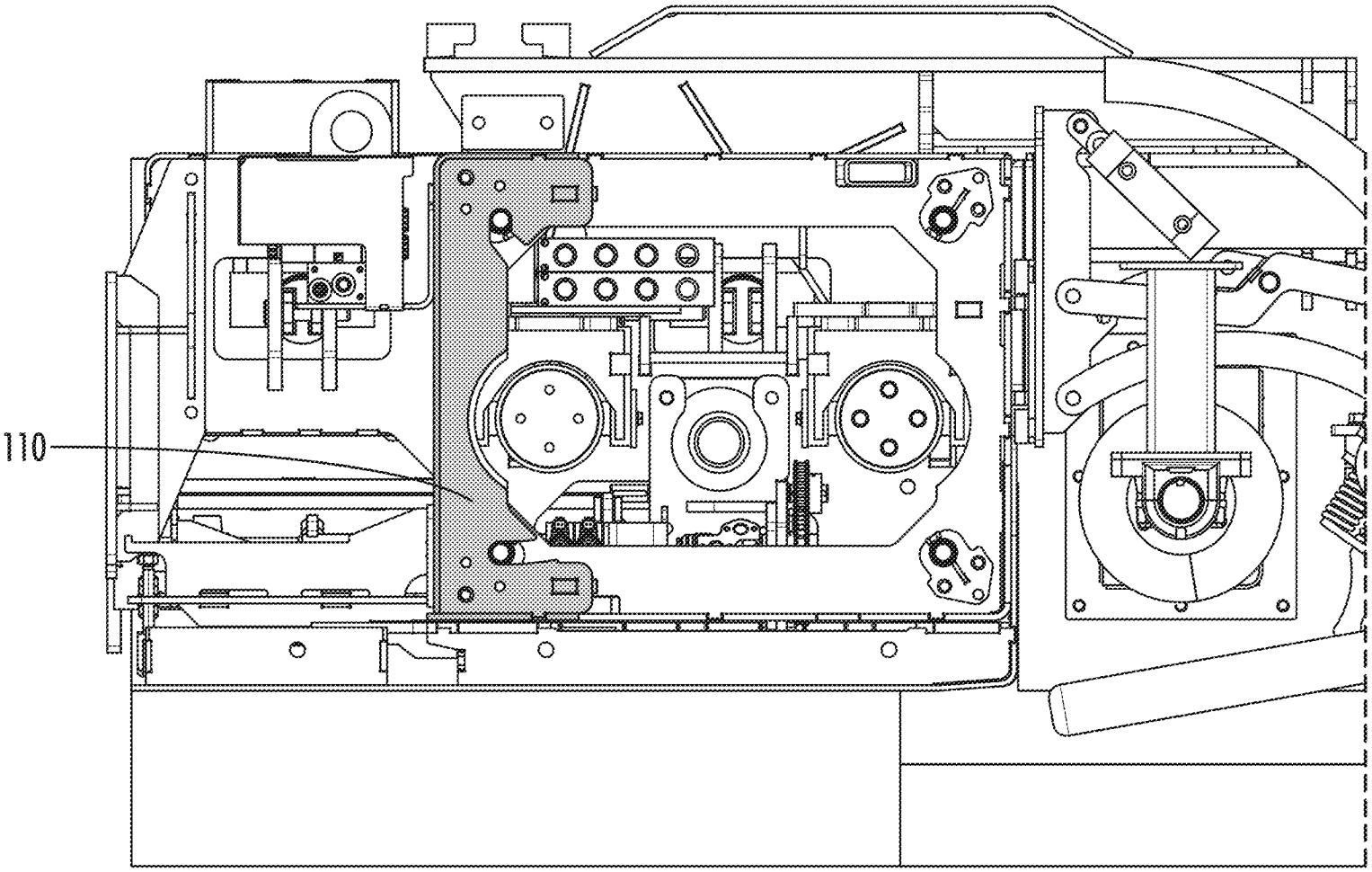

Similarly as shown in FIGS. 12A-12C the rearward spacer portion 110 includes an at least partially vertical upper slot 122 for hanging the rearward spacer portion 110 on the rearward upper hanger rod 104, and an at least partially horizontal lower slot 124 for receiving the rearward lower hanger rod 106 when the rearward spacer portion 110 is swung in a counterclockwise direction through the position of FIG. 12B to the substantially vertical orientation of FIG. 12C. After the forward and rearward spacer portions 108 and 110 are hung as shown in FIGS. 11C and 12C, the pan 112 is connected to the lower ends of the forward and rearward spacer portions 108 and 110, and the upper and lower adjustable length connectors 114 and 116 are connected between the forward and rearward spacer portions 108 and 110 to form the assembly shown in FIG. 13 wherein the spacer 76 is held upon the four hanger rods. When the left telescoping assembly 60 is retracted the one or more spacers 76 can slide upon the hanger rods so that the spacers 76 are firmly clamped between the left sideform assembly 52 and the center portion 46.

Figure 14:
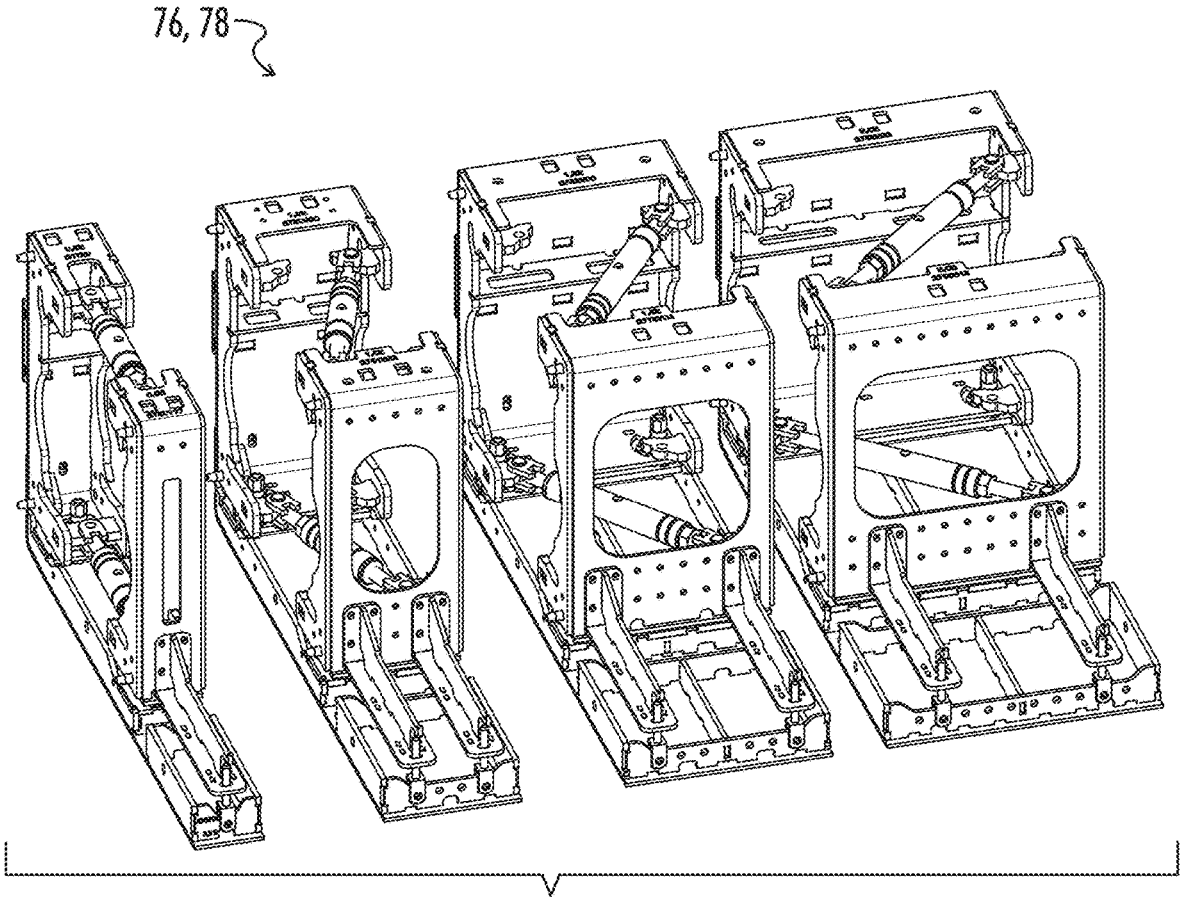
FIG. 14 is a perspective view of a side by side arrangement of four different sizes of spacers.

FIG. 14 illustrates in side by side fashion four different sizes of spacers 76, 78. From left to right the illustrated spacers have lateral widths of 0.5 ft, 1.0 ft, 1.5 ft and 2.0 ft, respectively. Each of the telescoping assemblies 60 and 68 may be configured to extend such as to provide a maximum space between the sideform assemblies and the center portion of about 3.0 ft so that one or more of the spacers 76, 78 may be required to fill the space.

As can be seen for example in FIG. 12A in lateral end view the plurality of left side hanger rods 100, 102, 104 and 106 define corners of an imaginary rectangular border 126. Center axes 128 and 130 of the forward and rearward left telescoping tube assemblies 61 and 63 all lie within the imaginary border 126.

Preferably each of the left side hanger rods 100-106 is fixedly attached to the left sideform assembly 52 and is slidably received through one or more openings in the left lateral end 48 of the center portion 46. Similarly, each of the right side hanger rods is fixedly attached to the right sideform assembly 56 and is slidably received through one or more openings in the right lateral and 50 of the center portion 46. Thus when the left sideform assembly 52 is retracted by the left telescoping assembly 60 toward the center portion 46, the left side hanger rods 100-106 may slide into the center portion 46. Similarly, when the right sideform assembly 56 is retracted by the right telescoping assembly 68, the right side hanger rods may slide into the center portion 46.

Thus it is seen that the apparatus and methods of the embodiments disclosed herein readily achieve the ends and advantages mentioned as well as those inherent therein. While certain preferred embodiments have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. An adjustable width mold apparatus for a slipform paver, the mold apparatus comprising:

a center portion terminating in left and right lateral ends;

a left sideform assembly including a laterally inner end;

a right sideform assembly including a laterally inner end;

a left adjustable width support assembly including a laterally outer end connected to the left sideform assembly and a laterally inner end connected to the center portion and extending laterally inward of the left lateral end, the left adjustable width support assembly including a left actuator for extending and retracting the left adjustable width support assembly;

a right adjustable width support assembly including a laterally outer end connected to the right sideform assembly and a laterally inner end connected to the center portion and extending laterally inward of the right lateral end, the right adjustable width support assembly including a right actuator for extending and retracting the right adjustable width support assembly;

one or more left spacers configured to be received between the laterally inner end of the left sideform assembly and the left lateral end of the center portion, such that upon retraction of the left adjustable width support assembly a laterally innermost one of the one or more left spacers is held directly against the left lateral end of the center portion; and one or more right spacers configured to be received between the laterally inner end of the right sideform assembly and the right lateral end of the center portion, such that upon retraction of the right adjustable width support assembly a laterally innermost one of the one or more right spacers is held directly against the right lateral end of the center portion.

2. The mold apparatus of claim 1, wherein:

the laterally outer end of the left adjustable width support assembly is connected to the left sideform assembly laterally outward of the laterally inner end of the left sideform assembly.

3. The mold apparatus of claim 1, wherein:

upon retraction of the left adjustable width support assembly a laterally outermost one of the one or more left spacers is held directly against the laterally inner end of the left sideform assembly.

4. The mold apparatus of claim 1, wherein:

the laterally inner end of the left adjustable width support assembly is connected to the center portion laterally inward of the left lateral end of the center portion; and the laterally inner end of the right adjustable width support assembly is connected to the center portion laterally inward of the right lateral end of the center portion.

5. The apparatus of claim 1, wherein:

the left actuator includes a rotary spindle connected to one of the left sideform assembly and the center portion, and a nut connected to the other of the left sideform assembly and the center portion, the rotary spindle being received in the nut.

6. The apparatus of claim 1, wherein:

the laterally inner end of the left telescoping support assembly is mounted on the center portion at a mounting location at least mid-way from the left lateral end of the center portion toward a lateral center of the center portion.

7. The apparatus of claim 1, wherein:

the center portion includes a left center portion half and a right center portion half joined together by a pivoted connection such that the left and right center portion halves can be pivoted relative to each other to form a crown in a molded structure.

8. The mold apparatus of claim 1, wherein the left adjustable width support assembly further includes:

a forward left telescoping tube assembly including a male tube connected to one of the left sideform assembly and the center portion, and a female tube connected to the other of the left sideform assembly and the center portion; and a rearward left telescoping tube assembly including a male tube connected to one of the left sideform assembly and the center portion, and a female tube connected to the other of the left sideform assembly and the center portion.

9. The mold apparatus of claim 8, wherein the left adjustable width support assembly further includes:

a bridge structurally connecting the female tubes of the forward and rearward left telescoping tube assemblies.

10. The mold apparatus of claim 8, wherein: the male tubes are connected to the left sideform assembly and the female tubes are connected to the center portion.

11. The apparatus of claim 10, further comprising:

a bridge structurally connecting the female tubes of the forward and rearward left telescoping tube assemblies; and wherein the left actuator is connected between the left sideform assembly and the bridge.

12. The apparatus of claim 11, wherein:

the left actuator includes a rotary spindle connected to the left sideform assembly and a nut connected to the bridge, the rotary spindle being received in the nut.

13. The apparatus of claim 1, further comprising:

a plurality of left side hanger rods extending between the left sideform assembly and the center portion, the left side hanger rods being separate from the left telescoping support assembly; and wherein the one or more left spacers are configured to be received on the left side hanger rods between the left sideform assembly and the center portion.

14. The mold apparatus of claim 13, wherein the plurality of left side hanger rods includes:

a forward upper hanger rod;

a forward lower hanger rod;

a rearward upper hanger rod; and a rearward lower hanger rod.

15. The mold apparatus of claim 14, wherein each of the one or more left spacers includes:

a forward spacer portion including an at least partially vertical upper slot for hanging the forward spacer portion on the forward upper hanger rod, and including an at least partially horizontal lower slot for receiving the forward lower hanger rod when the forward spacer portion is swung into a substantially vertical orientation after being hung on the forward upper hanger rod;

a rearward spacer portion including an at least partially vertical upper slot for hanging the rearward spacer portion on the rearward upper hanger rod, and including an at least partially horizontal lower slot for receiving the rearward lower hanger rod when the rearward spacer portion is swung into a substantially vertical orientation after being hung on the rearward upper hanger rod;

an upper length adjustable connector connecting upper ends of the forward and rearward spacer portions;

a lower length adjustable connector connecting lower ends of the forward and rearward spacer portions; and a pan connected to the lower ends of the forward and rearward spacer portions.

16. The mold apparatus of claim 14, wherein:

the left adjustable width support assembly further includes:

a forward left telescoping tube assembly including a male tube connected to one of the left sideform assembly and the center portion, and a female tube connected to the other of the left sideform assembly and the center portion; and a rearward left telescoping tube assembly including a male tube connected to one of the left sideform assembly and the center portion, and a female tube connected to the other of the left sideform assembly and the center portion;

in lateral end view the plurality of left side hanger rods define corners of an imaginary border; and center axes of the forward and rearward left telescoping tube assemblies and the left actuator all lie within the imaginary border.

17. The mold apparatus of claim 13, wherein:

each of the left side hanger rods is fixedly attached to the left sideform assembly and is slidably received through an opening in the left lateral end of the center portion; and each of the right side hanger rods is fixedly attached to the right sideform assembly and is slidably received through an opening in the right lateral end of the center portion.

18. An adjustable width mold apparatus for a slipform paver, the mold apparatus comprising:

a center portion;

a left sideform assembly;

a right sideform assembly;

a left adjustable width support assembly including a laterally outer end connected to the left sideform assembly and a laterally inner end connected to the center portion;

a left rotary spindle actuator for extending and retracting the left adjustable width support assembly, the left rotary spindle actuator including a left rotary spindle connected to one of the left sideform assembly and the center portion, and a left nut connected directly or indirectly to the other of the left sideform assembly and the center portion, the left rotary spindle being received in the left nut;

a right adjustable width support assembly including a laterally outer end connected to the right sideform assembly and a laterally inner end connected to the center portion;

a right rotary spindle actuator for extending and retracting the right adjustable width support assembly, the right rotary spindle actuator including a right rotary spindle connected to one of the right sideform assembly and the center portion, and a right nut connected directly or indirectly to the other of the right sideform assembly and the center portion, the right rotary spindle being received in the right nut; and one or more spacers configured to be received between the sideform assemblies and the center portion to adjust the width of the mold apparatus.

19. The apparatus of claim 18, wherein:

the laterally inner end of the left adjustable width support assembly is mounted on the center portion at a mounting location at least mid-way from a left lateral end of the center portion toward a lateral center of the center portion.

20. The apparatus of claim 18, wherein:

the center portion includes a left center portion half and a right center portion half joined together by a pivoted connection such that the left and right center portion halves can be pivoted relative to each other to form a crown in a molded structure.

21. The mold apparatus of claim 18, wherein the left adjustable width support assembly further includes:

a forward left telescoping tube assembly including a male tube connected to one of the left sideform assembly and the center portion, and a female tube connected to the other of the left sideform assembly and the center portion; and a rearward left telescoping tube assembly including a male tube connected to one of the left sideform assembly and the center portion, and a female tube connected to the other of the left sideform assembly and the center portion.

22. The mold apparatus of claim 21, wherein the left adjustable width support assembly further includes:

a bridge structurally connecting the female tubes of the forward and rearward left telescoping tube assemblies.

23. The mold apparatus of claim 21, wherein:

the male tubes are connected to the left sideform assembly and the female tubes are connected to the center portion.

24. The apparatus of claim 23, further comprising:

a bridge structurally connecting the female tubes of the forward and rearward left telescoping tube assemblies; and wherein the left actuator is connected between the left sideform assembly and the bridge.

25. The apparatus of claim 24, wherein:

the left rotary spindle is connected to the left sideform assembly and the left nut is connected to the bridge.

26. An adjustable width mold apparatus for a slipform paver, the mold apparatus comprising:

a center portion;

a left sideform assembly;

a right sideform assembly;

a left adjustable width support assembly including a laterally outer end connected to the left sideform assembly and a laterally inner end connected to the center portion;

a left actuator for extending and retracting the left adjustable width support assembly;

a right adjustable width support assembly including a laterally outer end connected to the right sideform assembly and a laterally inner end connected to the center portion;

a right actuator for extending and retracting the right adjustable width support assembly;

a plurality of left side hanger rods extending between the left sideform assembly and the center portion, the left side hanger rods being separate from the left adjustable width support assembly; and one or more left side spacers configured to be received on the left side hanger rods between the left sideform assembly and the center portion.

27. The mold apparatus of claim 26, wherein:

the center portion terminates in left and right lateral ends; and each of the left side hanger rods is fixedly attached to the left sideform assembly and is slidably received through an opening in the left lateral end of the center portion.

28. The mold apparatus of claim 26, wherein:

the left adjustable width support assembly further includes:

a forward left telescoping tube assembly including a male tube connected to one of the left sideform assembly and the center portion, and a female tube connected to the other of the left sideform assembly and the center portion; and a rearward left telescoping tube assembly including a male tube connected to one of the left sideform assembly and the center portion, and a female tube connected to the other of the left sideform assembly and the center portion;

in lateral end view the plurality of left side hanger rods define corners of an imaginary border; and center axes of the forward and rearward left telescoping tube assemblies and the left actuator all lie within the imaginary border.

29. The mold apparatus of claim 26, wherein the plurality of left side hanger rods includes:

a forward upper hanger rod;

a forward lower hanger rod;

a rearward upper hanger rod; and a rearward lower hanger rod.

30. The mold apparatus of claim 29, wherein each of the spacers includes:

a forward spacer portion including an at least partially vertical upper slot for hanging the forward spacer portion on the forward upper hanger rod, and including an at least partially horizontal lower slot for receiving the forward lower hanger rod when the forward spacer portion is swung into a substantially vertical orientation after being hung on the forward upper hanger rod;

a rearward spacer portion including an at least partially vertical upper slot for hanging the rearward spacer portion on the rearward upper hanger rod, and including an at least partially horizontal lower slot for receiving the rearward lower hanger rod when the rearward spacer portion is swung into a substantially vertical orientation after being hung on the rearward upper hanger rod;

an upper length adjustable connector connecting upper ends of the forward and rearward spacer portions;

a lower length adjustable connector connecting lower ends of the forward and rearward spacer portions; and a pan connected to the lower ends of the forward and rearward spacer portions.

* * * * *